US008376838B2

(12) United States Patent
Schulhof et al.

(10) Patent No.: US 8,376,838 B2
(45) Date of Patent: Feb. 19, 2013

(54) SECONDARY GAME MECHANISM FOR WAGERING GAME TABLES

(75) Inventors: Scott H. Schulhof, Chicago, IL (US); Alfred Thomas, Las Vegas, NV (US); Matthew J. Ward, Northbrook, IL (US)

(73) Assignee: WMS Gaming, Inc., Waukegan, IL (US)

( * ) Notice: Subject to any disclaimer, the term of this patent is extended or adjusted under 35 U.S.C. 154(b) by 271 days.

(21) Appl. No.: 12/840,682

(22) Filed: Jul. 21, 2010

(65) Prior Publication Data

US 2011/0034237 A1 Feb. 10, 2011

Related U.S. Application Data

(60) Provisional application No. 61/227,155, filed on Jul. 21, 2009.

(51) Int. Cl.
*A63F 9/24* (2006.01)

(52) U.S. Cl. ..... 463/25; 463/26; 463/17

(58) Field of Classification Search ..... 463/25, 463/26, 17

See application file for complete search history.

(56) References Cited

U.S. PATENT DOCUMENTS

| | | | | |
|---|---|---|---|---|
| 6,659,461 | B2 | 12/2003 | Yoseloff et al. | |
| 6,659,866 | B2 | 12/2003 | Frost et al. | |
| 7,537,456 | B2 | 5/2009 | Snow | |
| 7,559,839 | B2 | 7/2009 | Bahar | |
| 7,719,424 | B2 | 5/2010 | Steil | |
| 8,177,628 | B2 * | 5/2012 | Manning et al. | 463/21 |
| 2008/0085769 | A1 * | 4/2008 | Lutnick et al. | 463/41 |
| 2008/0261682 | A1 | 10/2008 | Phillips et al. | |
| 2009/0098921 | A1 * | 4/2009 | Manning et al. | 463/17 |
| 2009/0176546 | A1 | 7/2009 | Kyrychenko | |
| 2009/0280904 | A1 * | 11/2009 | Nicely et al. | 463/40 |
| 2010/0130280 | A1 | 5/2010 | Arezina et al. | |
| 2011/0065490 | A1 * | 3/2011 | Lutnick | 463/16 |
| 2011/0275432 | A1 * | 11/2011 | Lutnick et al. | 463/25 |
| 2012/0058814 | A1 * | 3/2012 | Lutnick et al. | 463/25 |

FOREIGN PATENT DOCUMENTS

| | | |
|---|---|---|
| WO | WO-2005104049 | 11/2005 |
| WO | WO-2006041614 | 4/2006 |
| WO | WO-2007027942 | 3/2007 |
| WO | WO-2008060886 | 5/2008 |

* cited by examiner

*Primary Examiner* — Pierre E Elisca
(74) *Attorney, Agent, or Firm* — DeLizio Gilliam, PLLC

(57) ABSTRACT

A wagering game system and its operations are described herein. In some embodiments, the operations can include detecting, via one or more sensory devices of a wagering game table, one or more game events associated with a wagering table game being played by a plurality of players on the wagering game table. The operations can also include determining that the one or more game events trigger a secondary game for the plurality of players playing the wagering table game, and presenting the secondary game on a plurality of display devices of the wagering game table. The operations can further include detecting, via one or more input devices of the wagering game table, player input associated with the secondary game, determining results associated with the secondary game based, at least in part, on the player input, and presenting the results associated with the secondary game on the plurality of display devices.

23 Claims, 8 Drawing Sheets

SECONDARY GAME MECHANISM FOR WAGERING GAME TABLES

RELATED APPLICATIONS

This application claims the priority benefit of U.S. Provisional Application Ser. No. 61/227,155 filed Jul. 21, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to a secondary game mechanism for wagering game tables in a wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments are illustrated in the Figures of the accompanying drawings in which.

DESCRIPTION OF THE EMBODIMENTS

This description of the embodiments is divided into five sections. The first section provides an introduction to some embodiments, while the second section describes example wagering game system architectures. The third section describes example operations performed by some embodiments and the fourth section presents some general comments.

Introduction

This section provides an introduction to some embodiments.

Wagering game systems offer wagering game players ("players") entertainment value and the opportunity to win monetary value. In some embodiments, wagering game systems may include wagering game tables comprising a mechanism for presenting secondary games to players while they play wagering table games to enhance the players' gaming experience. Wagering table games include wagering games that are played on a table and are managed by one or more dealers, e.g., blackjack, poker, roulette, craps, Texas hold'em, etc. Secondary games may include bonus games, side games, system wide progressive games, skill-based secondary economy games, and other types of games that are available via the wagering game system. The secondary games can also include other types of secondary applications such as promotional applications, social networking applications, player tracking applications, and patron services applications that are available via the wagering game system.

Figure 1:
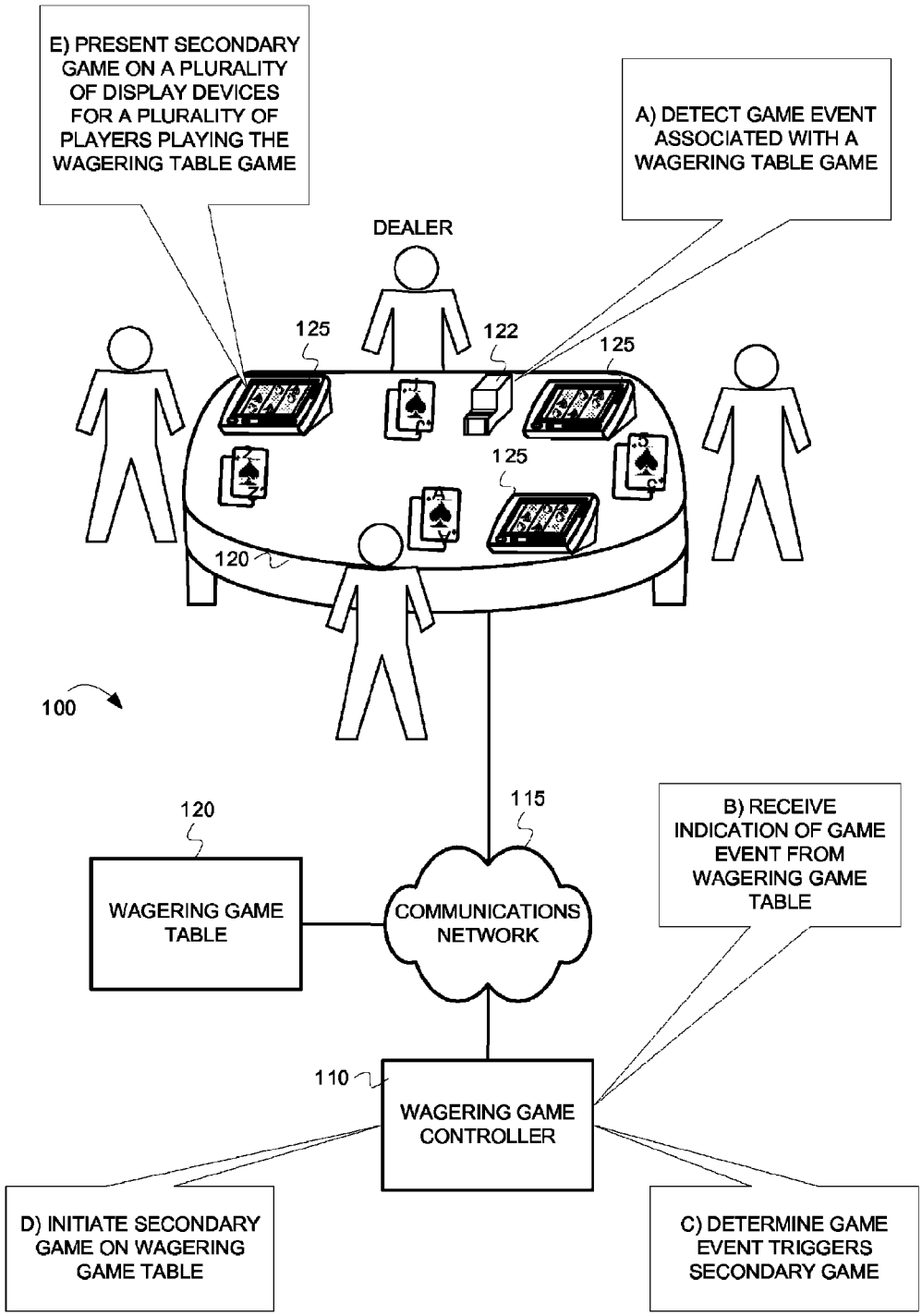
FIG. 1 is conceptual diagram that illustrates an example of implementing a secondary game mechanism in wagering game tables of a wagering game system, according to some embodiments.

FIG. 1 is conceptual diagram that illustrates an example of implementing a secondary game mechanism in wagering game tables of a wagering game system 100, according to some embodiments. In the example shown in FIG. 1, the wagering game system 100 includes a wagering game controller 110 and a plurality of wagering game tables 120 connected via a communication network 115. It is noted that although one example of a wagering game table for blackjack is shown in FIG. 1, the wagering game system 100 can include wagering game tables for other table games, e.g., poker, roulette, craps, Texas hold'em, etc. As illustrated, in some implementations, each wagering game table 120 includes one or more sensory devices 122 and a plurality of display devices 125. The sensory devices 122 can be one or more scanners (e.g., infrared laser scanners), one or more cameras (e.g., infrared cameras), and/or other devices used for detecting game events associated with the wagering table games. The display devices 125 can be a plurality of monitors, e.g., a plurality of sunk-in (i.e., recessed) LCD or plasma monitors, one for each player on the wagering game table 120. It is noted, however, that in other implementations the wagering game tables 120 can also be designed such that the plurality of monitors are mounted on a stand, mounted overhead, etc. Each wagering game table 120 may also include processing hardware/software to process game event data and other information associated with the wagering table games and communicate with the wagering game controller 110, as will be described further below with reference to FIG. 3.

In one implementation, at stage A, the wagering game table 120 detects a game event associated with a wagering table game being played by a plurality of players and managed by a dealer. A game event can be the act of dealing the cards and/or certain card combinations for card table games, the act of rolling the dice and/or certain dice combinations for dice table games, the act of spinning the roulette wheel or certain roulette wheel results, specific bet amounts, other table game results (e.g., award amounts), number of wins in a row, etc. In one example, the wagering game table 120 may include a scanning card shoe 122 that detects the act of dealing the cards and the specific suit and rank of each card dealt to each player playing the table game. In another example, the wagering game table 120 may include one or more cameras for detecting the cards that are dealt to each player, the dice combination that was rolled, the roulette wheel results, bet amounts, etc. At stage B, the wagering game controller 110 receives an indication of the game event from the wagering game table 120. For example, in a blackjack game, the wagering game table 120 can send a message to the wagering game controller 110 indicating that the cards have been dealt for the wagering table game, and/or may provide an indication of the suit and rank of each card dealt to each of the players.

At stage C, the wagering game controller 110 determines that the game event triggers a secondary game. In one example, the wagering game controller 110 determines that the act of dealing the cards (e.g., blackjack cards) triggers a side game where each player can place side bets on the wagering table game, e.g., bet whether one of the other players is going to win with the current hand, or trigger a system wide progressive game for all the players on the wagering game table 120. In another example, the wagering game controller 110 determines that one or more of the hands that were dealt to the players trigger a bonus game for all the players on the wagering game table 120. It is noted, however, that various other types of game events can trigger various types of secondary games, as will be further described below with reference to FIGS. 3-8. At stage D, the wagering game controller 110 initiates the secondary game for presentation at the wagering game table 120. At stage E, the wagering game table 120 presents the secondary game on the plurality of display devices 125 for the plurality of players playing the wagering table game. The wagering game table 120 detects player input associated with the secondary game, communicates with the wagering game controller 110 to determine the secondary game results, and presents the secondary game results to the players via the plurality of display devices 125. It is noted that the wagering game table 120 and the wagering game controller 110 can work together such that the wagering game table 120 can be operated as a thin, thick, or intermediate client, as will be further described below in FIG. 3.

Figure 2:
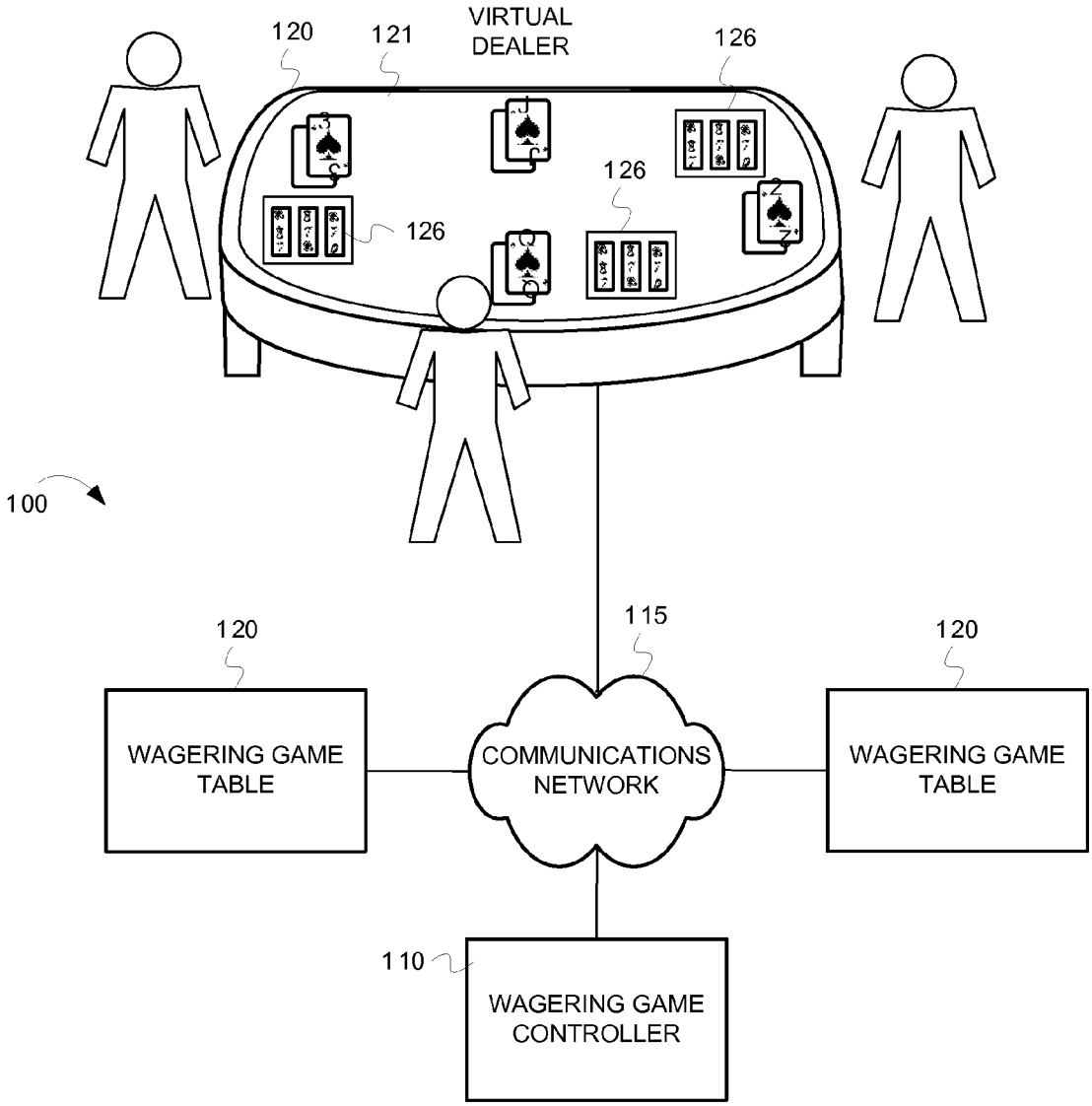
FIG. 2 is conceptual diagram that illustrates an example of implementing a secondary game mechanism in electronic wagering game tables of a wagering game system, according to some embodiments.

In some embodiments, as shown in the example of FIG. 2, the wagering game tables 120 of the wagering game system 100 may also comprise electronic wagering game tables, or e-tables, for playing wagering table games. In one example, the e-table includes a main display area 121 to present the wagering table game to a plurality of players. The e-table can also include player displays 126 within the main display area 121 to present the secondary games. For instance, the main display area 121 can be one or more display devices with multitouch capabilities. In another example, the e-table can include player displays that are separate from the main display area 121. In some examples, the e-table can comprise a mechanism to display a holographic image of the wagering table game to the plurality of players. For table games that typically require a dealer, e.g., blackjack, the e-table can include a virtual dealer. Similar to the example described above in FIG. 1, the e-table can detect table game events (i.e., via software instead of, or in addition to, sensory devices), communicate with the wagering game controller 110, and present secondary games to the players of the wagering table game.

Although FIGS. 1-2 describes some embodiments, the following sections describe many other features and embodiments.

Operating Environment

This section describes example operating environments and networks and presents structural aspects of some embodiments. More specifically, this section includes discussion about wagering game system architectures.

Wagering Game System Architectures

Figure 3:
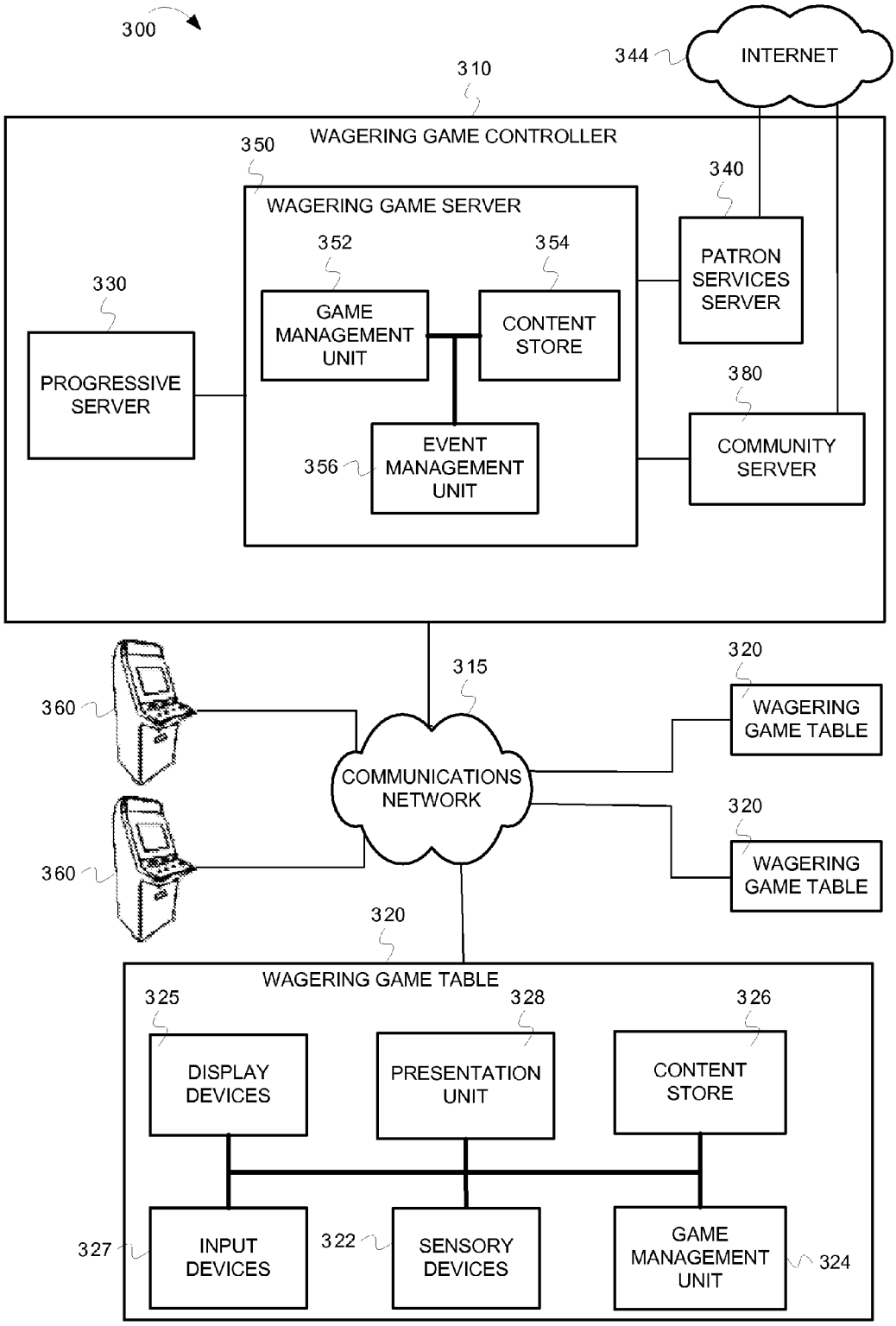
FIG. 3 is a conceptual diagram that illustrates an example of a wagering game system architecture, according to some embodiments.

FIG. 3 is a conceptual diagram that illustrates an example of a wagering game system architecture 300, according to some embodiments. As illustrated, the wagering game system architecture 300 includes a wagering game controller 310, a plurality of wagering game tables 320, and a plurality of wagering game machines 360. The wagering game controller 310 is configured to control game content (e.g., game results) and communicate game-related information and other information (e.g., social networking services) to and from the plurality of wagering game tables 320 and wagering game machines 360. In one embodiment, the wagering game controller 310 includes a wagering game server 350, a progressive server 330, a patron services server 340, and a community server 380.

The wagering game server 350 is configured to manage and control content for presentation on the wagering game tables 320 and the wagering game machines 360. For example, the wagering game server 350 includes a game management unit 352 configured to generate (e.g., using a random numbers generator) game results (e.g., win/loss values), including win amounts, for games played on the wagering game tables 320 (e.g., secondary games). The game management unit 352 can communicate the game results to the wagering game tables 320 via the network 315. In some implementations, the game management unit 352 can also generate random numbers and provide them to the wagering game tables 320 so that the wagering game tables 320 can generate game results. The wagering game server 350 can also include a content store 354 configured to store content used for presenting wagering games (e.g., secondary games) and other information on the wagering game tables 320 and the wagering game machines 360. The wagering game server 350 can also include an event management unit 356 configured to detect game event messages from the wagering game tables 320. The event management unit 356 is also configured to determine whether the game events trigger secondary games at the wagering game tables 320.

The progressive server 330 is configured to work in conjunction with the wagering game server 350 to manage progressive games and jackpots for the wagering game system. For example, the progressive server 330 can monitor game results generated by the wagering game server 350 and detect other game events associated with the wagering game tables 320 to manage progressive jackpots. The progressive server 330 can also present progressive jackpot awards on the wagering game tables 320.

The patron services server 340 is configured to provide players of the wagering game system access to patron services, for example, hotel and casino information (e.g., casino/hotel maps, hotel reservation system, etc.), casino game promotions (e.g., new game offerings and promotions), player account information (e.g., account status, adding credits to player cards, etc.), food and drink ordering capabilities, etc. The patron services server 340 can also provide players access to third-party services, such as Internet-related services. For example, the patron services server 340 can access Internet services and information related to finances, social networking, news, weather, email, sports, travel, shopping, etc. via the Internet 344.

The community server 380 is configured to provide a wide range of services to members of virtual gaming communities. For example, the community servers may allow players to:

Create Social Networks—When creating social networks, members can create electronic associations that inform network members when selected members are: 1) online, 2) performing activities, 3) reaching milestones, 4) etc.

Establish a Reputation—Community members can establish reputations based on feedback from other community members, based on accomplishments in the community, based on who is in their social network, etc.

Provide Content—Community members can provide content by uploading media, designing wagering games, maintaining blogs, etc.

Filter Content—Community members can filter content by rating content, commenting on content, or otherwise distinguishing content.

Interact with Other Members—Community members can interact via newsgroups, e-mail, discussion boards, instant messaging, etc.

Participate in Community Activities—Community members can participate in community activities, such as multiplayer games, interactive meetings, discussion groups, real-life meetings, etc.

Connect Casino Players to Online Members—Community members who are playing in casinos can interact with members who are online. For example, online members may be able to: see activities of social contacts in the casino, chat with casino players, participate in community games involving casino players, etc.

In some embodiments, the community server 380 enables online community members (e.g., operating a personal computer (PC) or a mobile device) to participate in and/or monitor wagering games that are being presented in one or more casinos. The community server 380 can enable community members to connect with and track each other. For example, the community server 380 can enable community members to select other members to be part of a social network. The community server 380 can also enable members of a social network to track what other social network members are doing in a virtual gaming community and a real-world casino. For example, in some implementations, the community server 380 assists in enabling members of a social network to see when network members are playing wagering game tables and machines in a casino, accessing a virtual gaming community web site, achieving milestones (e.g., winning large wagers in a casino), etc.

The community server 380 can store and manage content for a virtual gaming community. For example, in some embodiments, the community server 380 can host a web site for a virtual gaming community. Additionally, the community server 380 can enable community members and administrators to add, delete, and/or modify content for virtual gaming communities. For example, the community server 380 can enable community members to post media files, member-designed games, commentaries, etc., all for consumption by members of a virtual gaming community.

The community server 380 can track behavior of community members. In some embodiments, the community server 380 tracks how individuals and/or groups use the services and content available in a virtual gaming community. The community server 380 can analyze member behavior and categorize community members based on their behavior. The community server 380 can configure network components to customize content based on individual and/or group habits.

The community server 380 can manage various promotions offered to members of a virtual gaming community. For example, the promotions community server 380 can distribute promotional material when members achieve certain accomplishments (e.g., scores for online games) in a virtual gaming community. Members may use some of the promotional material when playing wagering games in a casino.

The plurality of wagering game tables 320 are configured to detect game events associated with a wagering table game that trigger secondary games, communicate with the wagering game controller 310, and present secondary games to players while they play the wagering table game. In some embodiments, a wagering game table 320 and the wagering game server 350 work together such that the wagering game table 320 can be operated as a thin, thick, or intermediate client. For example, one or more elements of game play may be controlled by the wagering game table 320 (client) or the wagering game server 350 (server). Game play elements can include executable game code, lookup tables, configuration files, game results, audio or visual representations of the game, game assets or the like. In a thin-client example, the wagering game server 350 can perform functions such as determining game results or managing assets, while the wagering game table 320 can present a audible/graphical representation of such outcome or asset modification to the players. In a thick-client example, the wagering game tables 320 can determine game outcomes and communicate the outcomes to the wagering game server 350 for recording or managing a player's account.

In some implementations, a wagering game table 320 can include a plurality of sensory devices 322, a game management unit 324, a plurality of display devices 325, a content store 326, a plurality of input devices 327, and a presentation unit 328. As described above, the sensory devices 322 (e.g., laser scanners, cameras, etc.) are configured to detect game events (e.g., card combinations, roulette wheel results, etc.) associated with wagering table games being played by a plurality of players on the wagering game table 320, and provide the game event data to the game management unit 324. The game management unit 324 is configured work in conjunction with the wagering game server 350 to process game events detected at the wagering game table 320 and present secondary games to the players (see FIGS. 4 and 5). For the e-table implementation described above, the game management unit 324 can also work in conjunction with the wagering game server 350 to present a wagering table game on a main display area of the wagering game table 320. The game management unit 324 can also generate game results based on random numbers received from the wagering game server 350, or may communicate with the wagering game server 350 to obtain the game results. The content store 326 is configured to store content used for presenting secondary games and other secondary application on the wagering game table 320.

The presentation unit 328 is configured to control the presentation of the game content associated with the secondary application on the plurality of display devices 325. The presentation unit 328 can include one or more browsers and any other software and/or hardware suitable for presenting audio and video content. It is noted, however, that in other implementations the game content can be presented using other display technologies. As described above, the display devices 325 can be a plurality of monitors (e.g., recessed LCD or plasma monitors). The plurality of input devices 327 can detect player input associated with the secondary games that are presented on the display devices 325, and provide the player input to the game management unit 324 to determine game results. The input devices 327 can be various types of input devices, such as touch screens, keyboards, buttons, joysticks, etc.

Each component shown in the wagering game system architecture 300 is shown as a separate and distinct element connected via a communications network 315. However, some functions performed by one component could be performed by other components. For example, the wagering game server 350 can be configured to perform some or all of the functions of the patron services server 340, and/or the game management unit 352 can be configured to perform some or all of the functions of the event management unit 356. Furthermore, the components shown may all be contained in one device, but some, or all, may be included in, or performed by multiple devices, as in the configurations shown in FIG. 3 or other configurations not shown. Furthermore, the wagering game system architecture 300 can be implemented as software, hardware, any combination thereof, or other forms of embodiments not listed. For example, any of the network components (e.g., the wagering game tables, machines, servers, etc.) can include hardware and machine-readable media including instructions for performing the operations described herein. Machine-readable media includes any mechanism that provides (i.e., stores and/or transmits) information in a form readable by a machine (e.g., a wagering game table, machine, computer, etc.). For example, tangible machine-readable storage media includes read only memory (ROM), random access memory (RAM), magnetic disk storage media, optical storage media, flash memory machines, and other types of tangible storage medium suitable for storing instructions. Machine-readable transmission media also includes any media suitable for transmitting software over a network.

Although FIG. 3 describes some embodiments, the following sections describe many other features and embodiments.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 4:
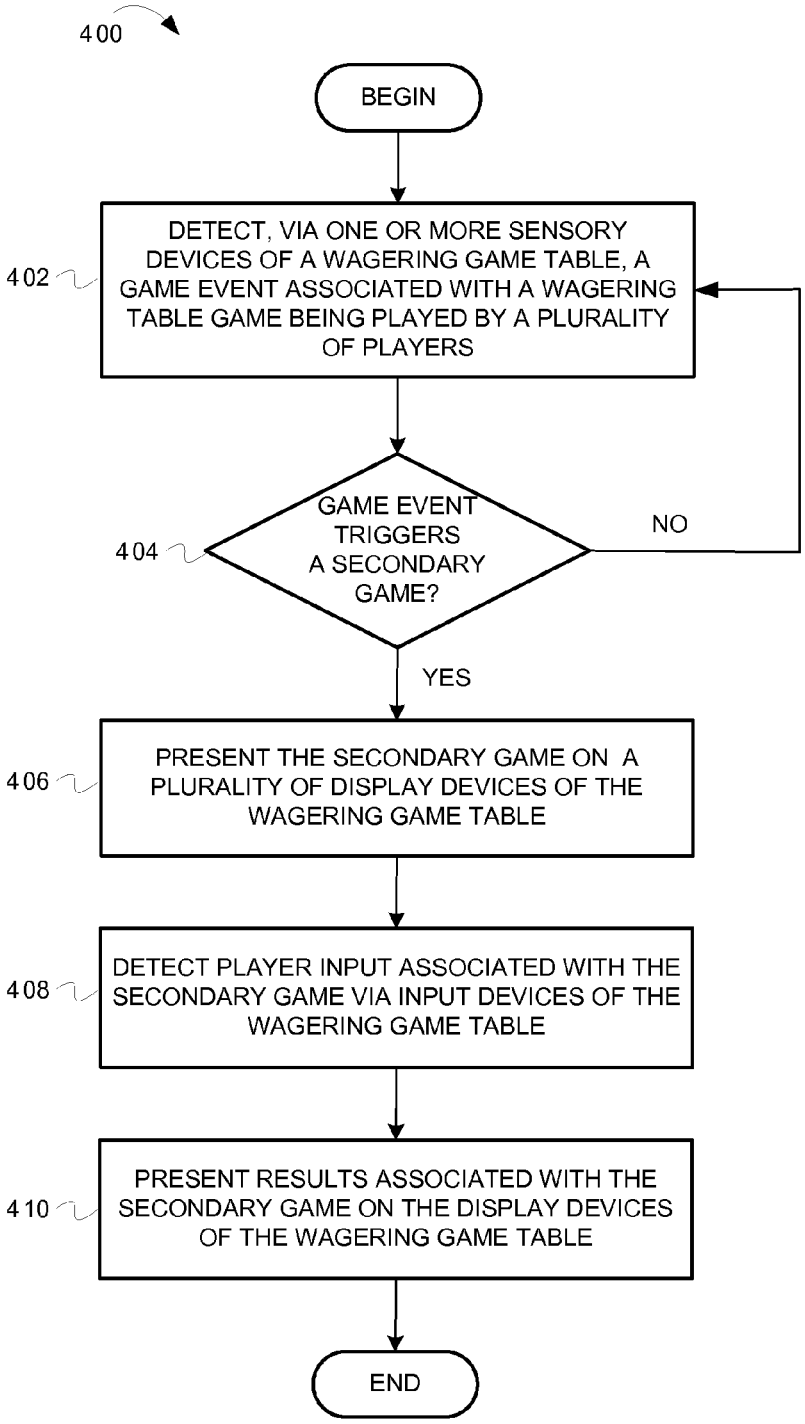
FIG. 4 is a flow diagram illustrating operations for detecting game events associated with a wagering table game that trigger secondary games and presenting the secondary games to players of the wagering table game, according to some embodiments.
Figure 5:
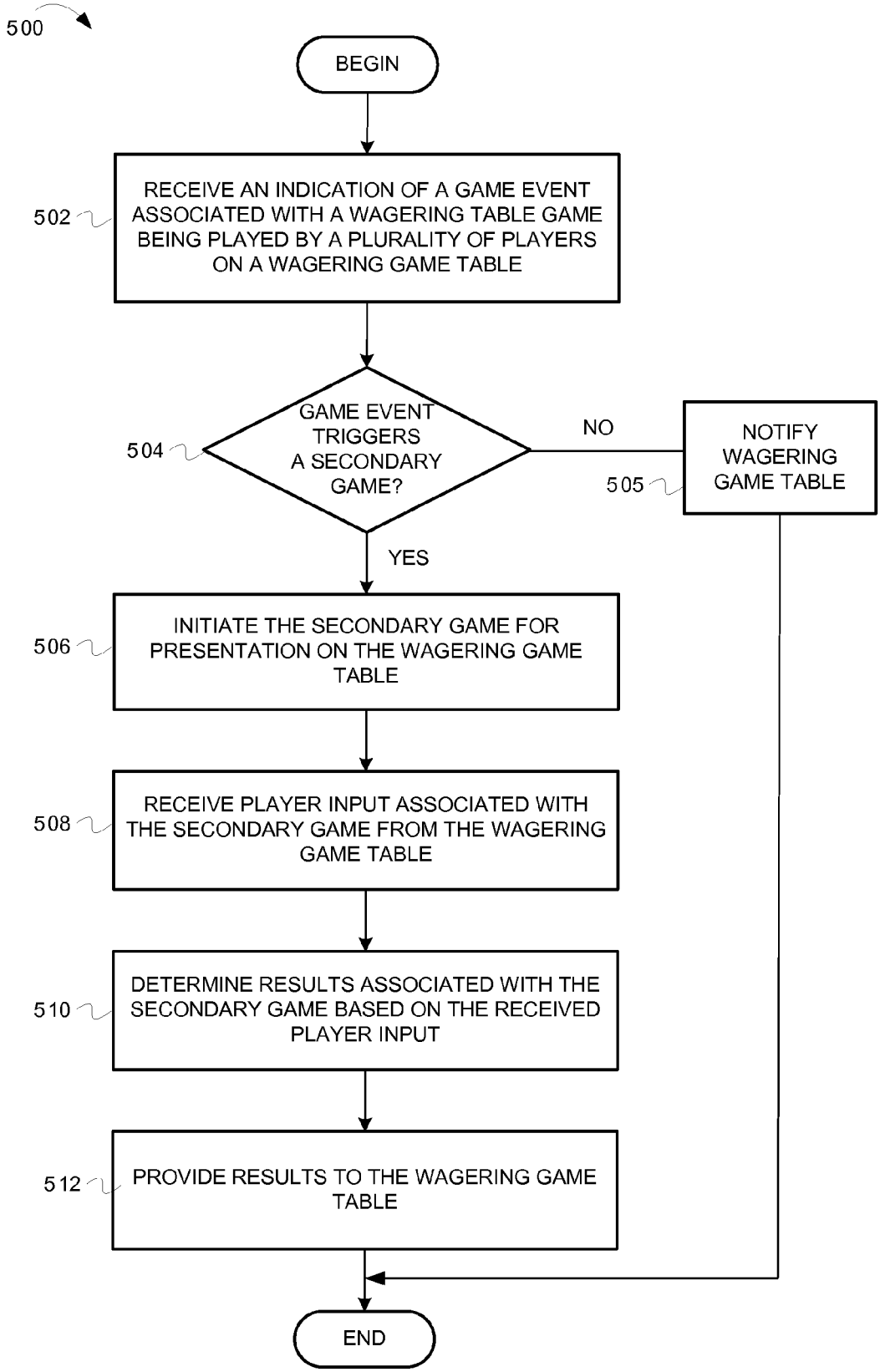
FIG. 5 is a flow diagram illustrating operations for initiating secondary games on a wagering game table, according to some embodiments.
Figure 6:
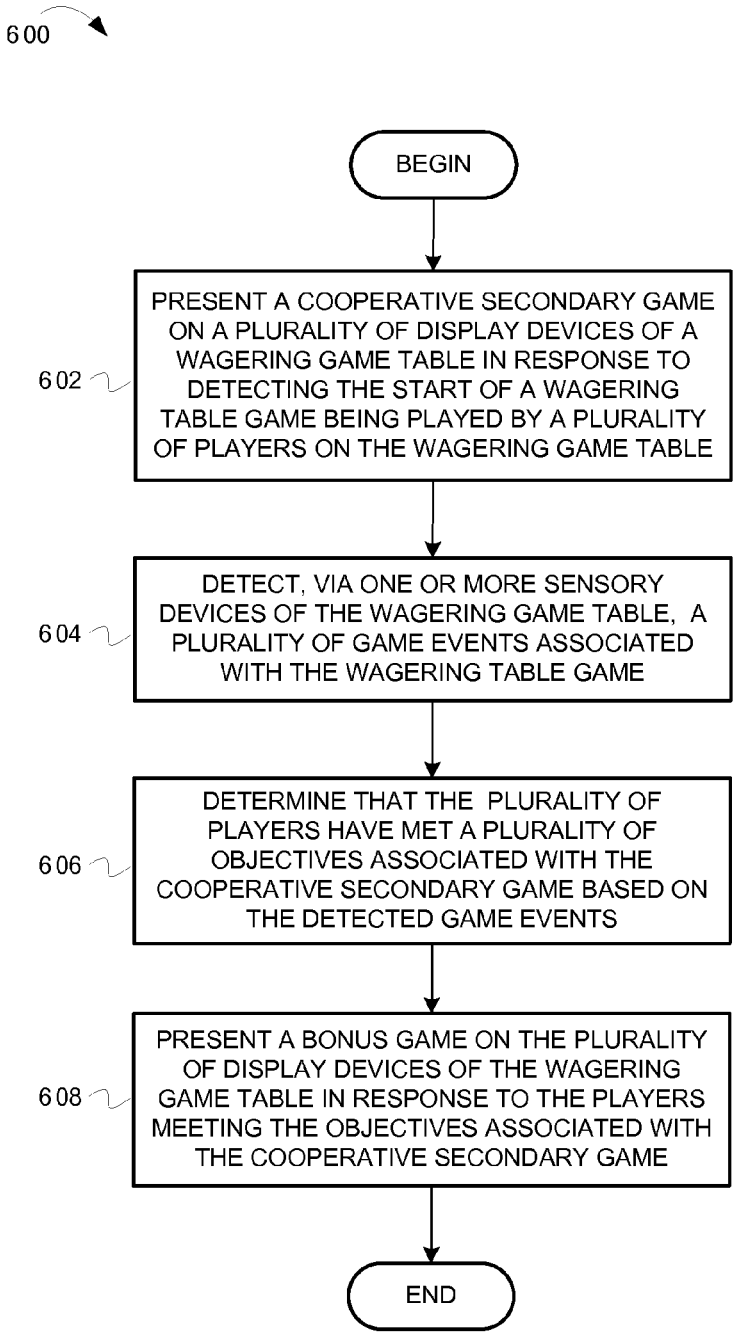
FIG. 6 is a flow diagram illustrating operations for detecting game events associated with a wagering table game being played by a plurality of players to determine whether the players, collectively, have met a plurality of objectives for a cooperative secondary game, according to some embodiments.
Figure 7:
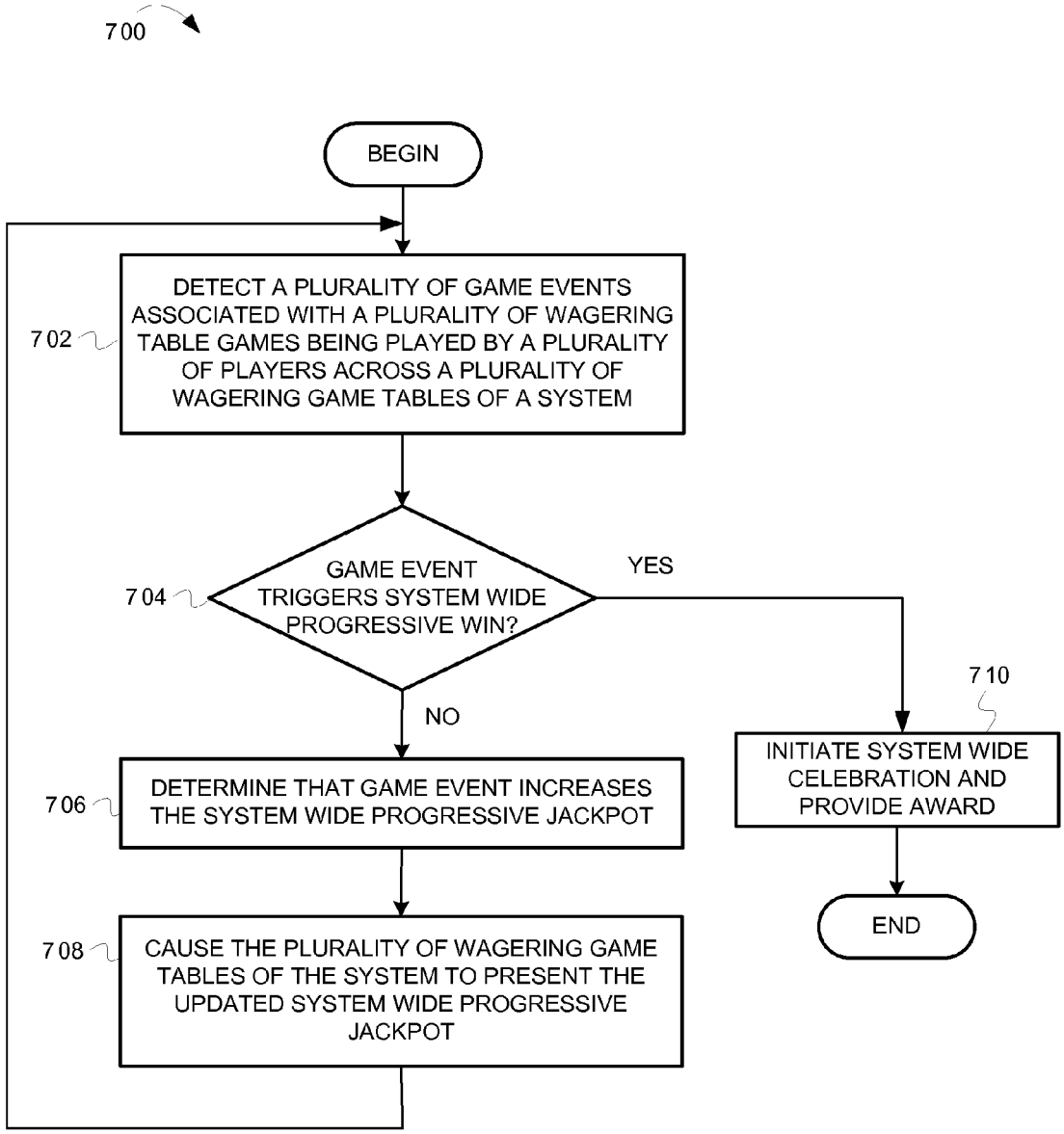
FIG. 7 is a flow diagram illustrating operations for detecting game events associated with a plurality of wagering table games being played in a wagering game system to manage a system wide progressive secondary game, according to some embodiments.
Figure 8:
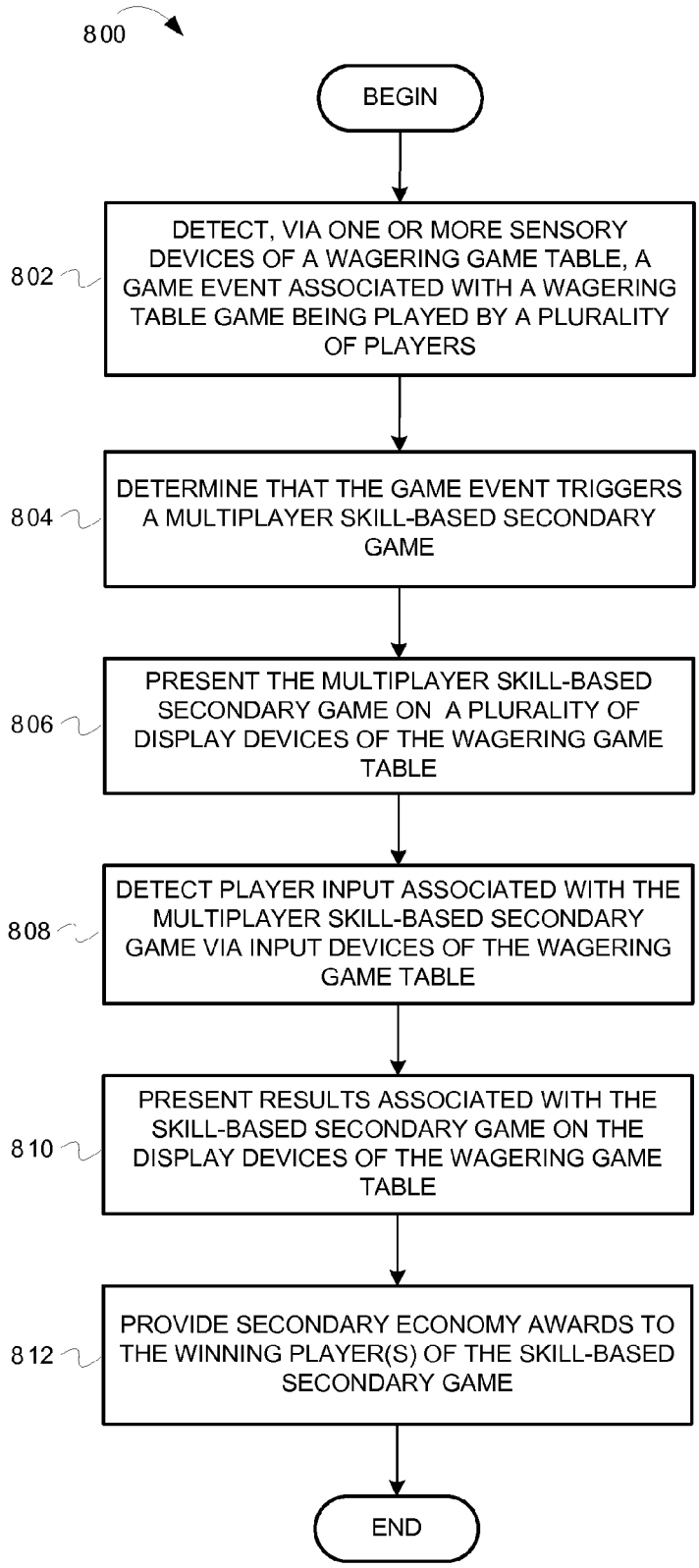
FIG. 8 is a flow diagram illustrating operations for detecting a game event associated with a wagering table game that triggers a multiplayer skill-based secondary game and presenting the skill-based secondary game to players of the wagering table game, according to some embodiments.

The following discussion of FIGS. 4-5 describes example mechanisms for detecting game events associated with a wagering table game that trigger secondary games and presenting the secondary games to players of the wagering table game. FIG. 6 describes an example mechanism for detecting game events associated with a wagering table game being played by a plurality of players to determine whether the players, collectively, have met a plurality of objectives for a cooperative secondary game. FIG. 7 describes an example mechanism for detecting game events associated with a plurality of wagering table games being played in a wagering game system to manage a system wide progressive secondary game. FIG. 8 describes an example mechanism for detecting a game event associated with a wagering table game that triggers a multiplayer skill-based secondary game and presenting the skill-based secondary game to players of the wagering table game.

FIG. 4 is a flow diagram ("flow") 400 illustrating operations for detecting game events associated with a wagering table game that trigger secondary games and presenting the secondary games to players of the wagering table game, according to some embodiments. The flow of 400 will be described with reference to the example system architecture of FIG. 3. The flow diagram begins at block 402.

At block 402, a wagering game table 320 detects a game event associated with a wagering table game being played by a plurality of players on the wagering game table 320. In some implementations, one or more sensory devices 322 of the wagering game table 320 detect the game event associated with the wagering table game. A game event can be various events associated with the wagering table game, e.g., the act of dealing the cards and/or certain card combinations for card table games, the act of rolling the dice and/or certain dice combinations for dice table games, the act of spinning the roulette wheel or certain roulette wheel results, specific bet amounts, other table game results (e.g., award amounts), number of wins in a row, etc. In one example, the wagering game table 320 may include a scanning card shoe (e.g., shoe 122 shown in FIG. 1) that detects the act of dealing the cards and the specific suit and rank of each card dealt to each player playing a table game (e.g., blackjack, poker, etc.). In another example, the wagering game table 320 may include one or more cameras for detecting the cards that are dealt to each player, dice combinations that are rolled (e.g., in a craps game), roulette wheel results, bet amounts, etc. The wagering game tables 320 can include a camera within a card shoe for reading cards, and/or a plurality of camera mounted within the wagering game table 320, positioned underneath a window (clear or opaque) on the table top to read the cards as they are dealt and read the cards that are face down in front of the players and dealer. The wagering game tables 320 can also include one or more cameras mounted on a stand or other structure to read the cards that are face up, detect the results of a dice roll, detect the results of a spin of a roulette wheel, detect bet amounts, detect game results, etc. After detecting the game events, the sensory devices 322 can provide game event data to the game management unit 324 for processing. After block 402, the flow continues at block 404.

At block 404, the wagering game table 320 determines whether the game event triggers a secondary game. For example, the game management unit 324 may receive the game event data from the sensory devices 322 indicating the detected game event (e.g., dealing of cards, specific card combination, dice roll, roulette wheel results, etc.), and may determine whether the game event triggers a secondary game. In some implementations, the game management unit 324 communicates with the wagering game server 350 to determine whether the game event triggers a secondary game. In one example, the game management unit 324 sends a message to the wagering game server 350 indicating the game event that was detected at the wagering game table 320. The wagering game server 350 can determine whether the game event triggers a secondary game. The wagering game server 350 may then provide content associated with the secondary game and other information to initiate the secondary game for presentation at the wagering game table 320. In other implementations, the game management unit 324 can determine whether the game event trigger a secondary game, and then send a notification message to the wagering game server 350 indicating that a game event detected at the wagering game table 320 triggers a certain secondary game. After block 404, if the game management unit 324 determines that the detected game event does not trigger a secondary game, the flow loops back to block 402 to continue detecting game events. If the game management unit 324 determines that the detected game event does trigger a secondary game, the flow continues at block 406.

At block 406, the wagering game table 320 presents the secondary game on the plurality of display devices 325. In some implementations, the game management unit 324 uses the presentation unit 328 to present the secondary game on the plurality of display devices 325. The type of game event that is detected at the wagering game table 320 may determine the secondary game that is presented at the wagering game table 320. In some examples, if the game event that is detected at the wagering game table 320 indicates the start of a wagering table game, e.g., the act of dealing the cards to the players, the game management unit 324 may present a side game to the players via the display devices 325. The result of the side game may be determined based on some aspect of the wagering table game. In one example, the side game may allow each of the players to place one or more additional bets on whether one or more of the other players playing the table game (e.g., blackjack) will win or lose. The side game may also allow players to challenge each other with side bets on who will win the next game. In another example, the side game may use aspects of the wagering table game, e.g., the cards that were dealt in the wagering table game, to determine a winner for the side game. The wagering game table 320 presents the side game and gives each of the players the option to place an additional bet for the side game. In one specific example, if the players are playing a blackjack table game, the side game may combine a player's first two cards and the dealer's first card for a three-card poker side game. In another specific example, if the players are playing a poker game, the side game may give the players the option to bet on which player has the highest value when you add up the cards in each player's hand. It is noted, however, that in other examples a various other types of side games can be offered to players of various types of wagering table game, where the result of the side game is dependent on some aspect of the wagering table game. For example, in a craps game, the players can place side bets to guess what player(s) will win on the next roll, or guess the specific dice combination the player will roll.

In other examples, if a game event is detected that triggers a secondary game, e.g., a specific card combination in card game (e.g., a straight or a flush in poker), a specific dice combination or win type in a craps game, a specific number of wins in a row in roulette, etc., the game management unit 324 may present a bonus game to the players via the display devices 325. It is noted that some or all of the bonus games that are presented to the players can be bonus games that are offered system wide via the wagering game controller 310. In one example, the game management unit 324 may present a bonus slot game to the players of the wagering table game, and provide each player a free spin. In another example, the game management unit 324 may present a bonus picking game to the players. Each player may then be offered the option to place additional bets to obtain additional spins for the slot game or additional picking opportunities for the picking game.

In some examples, the game management unit 324 may present an auction bonus game to the players of the wagering table game, in response to the detected game event. In one example, the game management unit 324 may present an item up for auction on the display devices 325 of the players and then the players are given the opportunity to bid for the item. The player with the highest bid wins the item. Various items can be placed up for bid via auction bonus games, e.g., entertainment tickets, hotel room upgrades, restaurant vouchers, vacation packages, spa treatments, etc. It is noted, however, that in various implementations game events can trigger other types of secondary games, e.g., cooperative play games (see FIG. 6), system wide progressive games (see FIG. 7), skill-based secondary economy games (see FIG. 8), among others. At least some of these secondary games that are offered to the players of the wagering table game can be games that are offered system wide via the wagering game controller 310. In some implementations, the game management unit 324 may present other secondary applications besides games, e.g., the game management unit 324 can present secondary applications for services offered by the patron services server 340 or the community server 380, e.g., secondary application that provide hotel and casino information (e.g., casino/hotel maps, hotel reservation system, etc.), casino game promotions (e.g., new game offerings and promotions), player account information (e.g., account status, adding credits to player cards, etc.), food and drink ordering capabilities, Internet access, social networking capabilities, etc. After block 406, the flow continues at block 408.

At block 408, the wagering game table 320 detects player input associated with the secondary game via one or more of the plurality of input devices 327. For example, the game management unit 324 can detect player input associated with the secondary application being presented on the display devices 325 via one or more of the input devices 327. For example, in a blackjack table game, one or more of the players may enter a bet of which player will win the next hand via a touch screen on a display device 325. In another example, the players may use buttons or a mouse to spin the bonus slot game, or to make selections in a bonus picking game, etc. In some embodiments, the game management unit 324 can determine the results of the secondary game based on the player input. For example, the player input may be a side bet entered by a player for a side game that is dependent on the results of the wagering table game. In this example, the game management unit 324 can determine the secondary game results based on the results of the wagering table game. In other embodiments, the game management unit 324 can provide the player input to the wagering game server 350 to determine the secondary game results. For some secondary games, e.g., bonus games such as slots or picking games, the game management unit 324 may receive random numbers from the wagering game server 350 to determine the secondary game results. After block 408, the flow continues at block 410.

At block 410, the wagering game table 320 presents the results associated with the secondary game on the display devices 325 of the wagering game table 320. In one example, the game management unit 324 can use the presentation unit 328 to display the one or more winners of the secondary game and the award that was won (e.g. chips, monetary awards/credits, etc.). In some examples, the secondary game may award non-monetary awards, such as secondary economy assets. Secondary economy and secondary economy assets are described below with reference to FIG. 8. After block 410, the flow ends.

FIG. 5 is a flow diagram ("flow") 500 illustrating operations for initiating secondary games on a wagering game table, according to some embodiments. The flow of 500 will be described with reference to the example system architecture of FIG. 3. The flow diagram begins at block 502.

At block 502, the wagering game server 350 receives an indication of a game event associated with a wagering table game being played by a plurality of players on a wagering game table 320. In one implementations, the event management unit 356 may receive a message from the wagering game table 320 indicating the type of game event that was detected at the wagering game table 320, e.g., the act of dealing the cards and/or certain card combinations for card table games, the act of rolling the dice and/or certain dice combinations for dice table games, the act of spinning the roulette wheel or certain roulette wheel results, specific bet amounts, other table game results (e.g., award amounts), number of wins in a row, etc. After block 502, the flow continues at block 504.

At block 504, the wagering game server 350 determines whether the game event triggers a secondary game. In one implementation, the event management unit 356 determines whether the game event triggers a secondary game, and also determines the type of secondary game the game event triggers based on the type of game event, e.g., as was described above with reference to FIG. 4. After block 504, if the event management unit 356 determines that the game event does not trigger a secondary game, at block 505, the event management unit 356 sends a notification message to the wagering game table 320, and then the flow ends. If the event management unit 356 determines that the detected game event does trigger a secondary game, the flow continues at block 506.

At block 506, the wagering game server 350 initiates the secondary game for presentation on the wagering game table 320. In some embodiments, the game management unit 352 of the wagering game server 350 may provide content associated with the secondary game and other information to initiate the secondary game for presentation at the wagering game table 320. After block 506, the flow continues at block 508.

At block 508, the wagering game server 350 receives player input associated with the secondary application from the wagering game table 320. For example, the wagering game table 320 may provide player input to the wagering game server 350 to determine the results of the secondary game. After block 508, the flow continues at block 510.

At block 510, the wagering game server 350 determines the results associated with the secondary game based on the received player input. For example, the received player input may be a side bet entered by a player for a side game that is dependent on the results of the wagering table game. In this example, the game management unit 352 can determine the secondary game results based on the results of the wagering table game. For some secondary games, e.g., bonus games such as slots or picking games, the game management unit 352 may receive player input indicating the player hit the spin button or indicating the player selection in a picking game. In this case, the game management unit 352 may generate random numbers to determine the secondary game results. As noted above with reference to FIG. 4, in some implementations, the wagering game server 350 may generate and provide random numbers to the wagering game table 320 so that the wagering game table 320 can determine the secondary game results. After block 510, the flow continues at block 512.

At block 512, the wagering game server 350 provides the secondary game results to the wagering game table 320. For example, the game management unit 352 can send a message including the secondary game results to the wagering game table 320. After block 512, the flow ends.

FIG. 6 is a flow diagram ("flow") 600 illustrating operations for detecting game events associated with a wagering table game being played by a plurality of players to determine whether the players, collectively, have met a plurality of objectives for a cooperative secondary game, according to some embodiments. The flow of 600 will be described with reference to the example system architecture of FIG. 3. The flow diagram begins at block 602.

At block 602, a wagering game table 320 presents a cooperative secondary game in response to detecting the start of a wagering table game being played by a plurality of players on a wagering game table 320. In various embodiments, the game management unit 324 presents the cooperative secondary game on a plurality of display devices 325 of the wagering game table 320. After block 602, the flow continues at block 604.

At block 604, the wagering game table 320 detects a plurality of game events associated with the wagering table game being played by the plurality of players. In some implementations, one or more sensory devices 322 of the wagering game table 320 detect the plurality of game events associated with the wagering table game, as was described above with reference to FIG. 4. At the same time that the players are playing the wagering table game, the game management unit 324 presents the cooperative secondary game on the plurality of display devices 325. For the cooperative secondary game, the game management unit 324 tracks the game events associated with the wagering table game and determines whether each game event meets one of a plurality of objectives for the cooperative secondary game. The plurality of the players, collectively, have to meet the plurality of objectives associated with the cooperative secondary game in order to be awarded a bonus game, or other type of secondary game, that gives the players a chance to win an award (e.g., a monetary or non-monetary award). For example, in a poker table game, the plurality of objectives associated with the cooperative secondary game may be the players collectively getting a plurality of predefined poker hands, e.g., the players getting a full house, a three of a kind, a straight, and a flush. In this example, while the players play the poker table game, the game management unit 324 tracks the players' hands to determine whether any of the players have one of the predefined poker hands. After the players reveal their hands, if one of the players has one of the predefined poker hands, the game management unit 324 notifies the plurality of players via the displays 325 that one out of the four objectives for the cooperative secondary game has been met. In one example, for the cooperative secondary game, the game management unit 324 may present a graphical representation of the four predefined poker hands on the displays 325. Each time the players get one of the predefined poker hands, the game management unit 324 updates the graphical representation to indicate that the poker hand has been detected, e.g., highlight or check off the graphical representation of the detected poker hand. In another example, in a blackjack table game, the plurality of objectives may be 10 wins with a 21 and 10 wins with a 20. It is noted, however, that a cooperative secondary game may be implemented for other wagering table games, and the plurality of objectives associated with the cooperative secondary game may vary from one implementation to another, and may be programmable by the operator of the wagering game system. After block 604, the flow continues at block 606.

At block 606, the wagering game table 320 determines that the plurality of players have met the plurality of game objectives associated with the cooperative secondary game based on the detected game events. In some implementations, the game management unit 324 determines that the plurality of players have met the plurality of game objectives associated with the cooperative secondary game based on the detected game events. After block 606, the flow continues at block 608.

At block 608, the wagering game table 320 presents a bonus game on the plurality of display devices 325 in response to the players meeting the objectives associated with the cooperative secondary game. In some implementations, the game management unit 324 presents a bonus game on the plurality of display devices 325. For example, the game management unit 324 can present a slots bonus game on the display devices 325 and each player is given one or more free spins to win monetary awards. In another example, the game management unit 324 presents a picking bonus game and each player is given one or more free picks to win monetary awards. In some implementations, after the free bonus rounds, the players may be given the option to place bets to continue playing the bonus game. It is noted that in other implementations, in response to meeting the objectives associated with the cooperative secondary game, the players are awarded with other types of bonus games or other types of secondary games that give the players a chance to win an award, e.g., one or more spins in a roulette bonus game for monetary awards, or a skilled-based bonus game for secondary economy assets (e.g., see FIG. 8). As described above with reference to FIG. 4, the game management unit 324 may then detect player input associated with the bonus game (e.g., a spin for the slot bonus game or a selection for the picking bonus game), and present the results of the bonus game on the display devices 325. After block 608, the flow ends.

In some implementations, the cooperative secondary game can be a scavenger hunt, where the players are presented with multiple secondary games. The plurality of players play the multiple secondary games and the game management unit 324 determines whether game events associated with the multiple secondary games meet a plurality of objectives of the cooperative scavenger hunt game. The game management unit 324 presents a bonus game when all the objectives of the cooperative scavenger hunt game are met. In e-table implementation (e.g., see FIG. 2), the game management unit 324 can track game events associated with multiple wagering table games that are presented in the main display area to determine whether the players meet a plurality of objectives of a cooperative scavenger hunt game.

FIG. 7 is a flow diagram ("flow") 700 illustrating operations for detecting game events associated with a plurality of wagering table games being played in a wagering game system to manage a system wide progressive secondary game, according to some embodiments. The flow of 700 will be described with reference to the example system architecture of FIG. 3. The flow diagram begins at block 702.

At block 702, the wagering game server 350 determines a plurality of game events associated with a plurality of wagering table games being played by the plurality of players across a plurality of wagering game tables 320 of the wagering game system 300. In various embodiments, as described in FIGS. 4 and 5, the wagering game tables 320 can detect game events and report the game events to the wagering game server 350, e.g., by sending a message indicating the type of game event that was detected at the wagering game table 320. The event management unit 356 of the wagering game server 350 determines the plurality of game events based on the messages received from the wagering game tables 320. After block 702, the flow continues at block 704

At block 704, the wagering game server 350 determines whether each game event triggers a win on a system wide progressive secondary game. In some implementations, the event management unit 356 determines whether a game event triggers a win on a system wide progressive secondary game. For example, in some card table games, a specific card combination can win the system wide progressive jackpot. It is noted, however, that in other examples a win of the system wide progressive jackpot can be triggered after a random number of games (e.g., determined by a random number generator) are initiated across the wagering game system 300. After block 704, if a game event triggers a win of the system wide progressive secondary game, the flow continues at block 710. If the game event does not triggers a win of the system wide progressive secondary game, the flow continues at block 706.

At block 706, the wagering game server 350 determines that the game event increases the system wide progressive jackpot. In some implementations, even though the game event did not trigger a win of the progressive jackpot, the event management unit 356 determines that the game event increases the progressive jackpot. For example, each game event that indicates the start of a wagering table game can increase the progressive jackpot. In some examples, other game events can also increase the progressive jackpot, e.g., certain card combinations in card table games, certain dice rolls in a craps table game, etc. After block 706, the flow continues at block 708.

At block 708, the wagering game server 350 causes the plurality of wagering game tables 320 to present the updated system wide progressive jackpot. In some implementations, the game management unit 352 sends a message to the plurality of wagering game tables 320 to report the updated progressive jackpot and cause the wagering game tables 320 to present the updated progressive jackpot on a plurality of display devices 325. After block 708, the flow loops back to block 702 to continue detecting game events.

At block 710, when one of the game events triggers a win of the system wide progressive jackpot, the wagering game server 350 initiates a system wide celebration on the plurality of wagering game tables 320 and provides the award to the player that won the progressive jackpot. In some implementations, the game management unit 352 can send a celebration file and other celebration content to the plurality of wagering game tables 320 to cause the plurality of displays 325 to present the celebration to the plurality of players across the wagering game system 300. After block 710, the flow ends.

It is noted that in some embodiments, similar to the system wide progressive secondary game, each wagering game table 320 can be configured to manage a table-specific jackpot secondary game, which maintains a jackpot that can be won by the players at the wagering game table 320 only. For example, the game management unit 324 of the wagering game table 320 can track events associated with the wagering table game being played by a plurality of players, determine whether a game event triggers a win of the jackpot, determine whether a game event increases the jackpot, and present updates and other content associated with the jackpot secondary game via the display devices 325 of the wagering game table 320.

FIG. 8 is a flow diagram ("flow") 800 illustrating operations for detecting a game event associated with a wagering table game that triggers a multiplayer skill-based secondary game and presenting the skill-based secondary game to players of the wagering table game, according to some embodiments. The flow of 800 will be described with reference to the example system architecture of FIG. 3. The flow diagram begins at block 802.

At block 802, a wagering game table 320 detects a game event associated with a wagering table game being played by a plurality of players on the wagering game table 320. In some implementations, one or more sensory devices 322 of the wagering game table 320 detect the game event associated with the wagering table game, e.g. as described above with reference to FIG. 4. After block 802, the flow continues at block 804.

At block 804, the wagering game table 320 determines that the game event triggers a multiplayer skill-based secondary game. For example, the game management unit 324 may receive game event data from the sensory devices 322 indicating the detected game event, and may determine that the game event triggers a skill-based secondary game. A skill-based secondary game is a type of secondary game in which a player can utilize physical skill, strategy, knowledge, dexterity, or other types of abilities to manipulate, organize, select, or in any other way control secondary game play elements to accomplish secondary game objectives. In some skill-based secondary games, the higher the skill the player exhibits in accomplishing the secondary game objectives during game play, the greater the award the wagering game systems provides to the player. For example, in a horse racing skill-based secondary game, the wagering game table 320 may reward a player that finishes in first place a larger award than a player that finishes in second or third place. In various implementations, the wagering game table 320 rewards players of skill-based secondary games non-monetary secondary economy assets. Secondary economy assets may include non-monetary awards, such as secondary economy credits, which may be redeemable for various items offered by a wagering game system operator and its business partners. The non-monetary awards can include merchandise, hotel stay credits, etc. The non-monetary awards can also include secondary economy virtual assets, such as, special avatars and graphical trophies that indicate a player's skill, status, and/or accomplishments. It is noted, however, that in other implementations the wagering game table 320 may provide monetary awards to players that are entitled to an award after playing the skill-based secondary game. It is further noted that in other embodiments secondary economy assets may also be provided to players of non-skill based secondary games. After block 804, the flow continues at block 806.

At block 806, the wagering game table 320 presents the multiplayer skill-based secondary game on the plurality of display devices 325. In some implementations, the game management unit 324 uses the presentation unit 328 to present the skill-based secondary game on the plurality of display devices 325. For example, the players playing the wagering table game may play a horse racing skill-based secondary game against each other. It is noted that in other implementations the wagering game table 320 can present a variety of other types of multiplayer skill-based secondary games to the players, e.g., fighting games, sports games, other types of racing games (car, boat, obstacle course, etc.), shooting games, etc. After block 806, the flow continues at block 808.

At block 808, the wagering game table 320 detects player input associated with the multiplayer skill-based secondary game via one or more of the plurality of input devices 327. After block 808, the flow continues at block 810.

At block 810, the wagering game table 320 presents the results associated with the multiplayer skill-based secondary game on the display devices 325 of the wagering game table 320. In one example, the game management unit 324 can use the presentation unit 328 to display the results and the winner of the skill-based secondary game. After block 810, the flow continues at block 812.

At block 812, the wagering game table 320 provides a secondary economy award to the eligible winner(s) of the multiplayer skill-based secondary game. In one example, the game management unit 324 can provide secondary economy credits or a secondary economy trophy to the winner(s) of the skill-based secondary game. After block 812, the flow ends.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method comprising:

detecting, via one or more sensory devices of a wagering game table of a wagering game system, one or more game events associated with a wagering table game being played by a plurality of players on the wagering game table;

determining, at the wagering game table, that the one or more game events trigger a secondary game for the plurality of players playing the wagering table game;

presenting the secondary game on a plurality of display devices of the wagering game table;

detecting, via one or more input devices of the wagering game table, player input associated with the secondary game;

determining, at the wagering game table, results associated with the secondary game based, at least in part, on the player input; and presenting the results associated with the secondary game on the plurality of display devices of the wagering game table.

2. The method of claim 1, wherein said determining, at the wagering game table, the results associated with the secondary game comprises determining the results associated with the secondary game based on the player input and results associated with the wagering table game.

3. The method of claim 1, further comprising:

receiving, at the wagering game table, random numbers from a wagering game server of the wagering game system via a communications network; and determining, at the wagering game table, the results associated with the secondary game based on the player input and the random numbers received from the wagering game server.

4. The method of claim 1, wherein said determining, at the wagering game table, results associated with the secondary game comprises receiving results from a wagering game server of the wagering game system via a communication network.

5. The method of claim 1, wherein the one or more sensory devices comprises a plurality of infrared cameras for detecting one or more game events associated with the wagering table game.

6. The method of claim 1, wherein the one or more game events associated with the wagering table game include at least one of an act of dealing cards in a card table game, a player's hand after the cards are dealt in a card table game, an act of rolling dice in a dice table game, a dice roll result in dice table games, an act of spinning a roulette wheel in a roulette table game, a roulette spin result in a roulette table game, a bet above a predefined bet amount, an award above a predefined award amount, and a predefined number of wins in a row.

7. The method of claim 1, wherein the wagering table game is one of a blackjack table game, a poker table game, a roulette table game, a craps table game, and a Texas hold'em table game.

8. The method of claim 1, further comprising presenting, on the plurality of display devices of the wagering game table, a mechanism for the plurality of players to enter a bet in order to play the secondary game.

9. The method of claim 1, wherein the secondary game is a side game, wherein the method further comprises:

presenting, on the plurality of display devices of the wagering game table, a mechanism for the plurality of players to enter a side bet in order to play the side game; and determining, at the wagering game table, the results associated with the side game based on the player input and results associated with the wagering table game.

10. The method of claim 1, wherein the secondary game is a cooperative secondary game, wherein the method further comprises:

detecting, via the one or more sensory devices, a plurality of game events associated with the wagering table game;

determining, at the wagering game table, that the plurality of players have met a plurality of objectives associated with the cooperative secondary game based on the plurality of game events; and presenting a bonus game on the plurality of display devices of the wagering game table in response to the players meeting the objectives associated with the cooperative secondary game.

11. The method of claim 1, further comprising:

awarding, at the wagering game table, secondary economy assets to one or more of the players based on the results associated with the secondary game.

12. A wagering game table comprising:

one or more sensory devices configured to detect one or more game events associated with a wagering table game being played by a plurality of players on the wagering game table; and a game management unit configured to determine that the one or more game events trigger a secondary game for the plurality of players playing the wagering table game, and configured to present the secondary game on a plurality of display devices of the wagering game table;

detect player input associated with the secondary game;

determine results associated with the secondary game based, at least in part, on the player input; and present the results associated with the secondary game on the plurality of display devices of the wagering game table.

13. The wagering game table of claim 12, wherein the game management unit is configured to determine the results associated with the secondary game based on the player input and results associated with the wagering table game.

14. The wagering game table of claim 12, wherein the game management unit is configured to receive random numbers from a wagering game server of the wagering game system via a communications network, and determine the results associated with the secondary game based on the player input and the random numbers received from the wagering game server.

15. The wagering game table of claim 12, wherein, to determine the results associated with the secondary game, the game management unit is configured to receive results from a wagering game server of the wagering game system via a communication network.

16. The wagering game table of claim 12, wherein the one or more sensory devices comprises a plurality of infrared cameras for detecting one or more game events associated with the wagering table game.

17. The wagering game table of claim 12, wherein the one or more game events associated with the wagering table game include at least one of an act of dealing cards in a card table game, a player's hand after the cards are dealt in a card table game, an act of rolling dice in a dice table game, a dice roll result in dice table games, an act of spinning a roulette wheel in a roulette table game, a roulette spin result in a roulette table game, a bet above a predefined bet amount, an award above a predefined award amount, and a predefined number of wins in a row.

18. The wagering game table of claim 12, wherein the wagering table game is one of a blackjack table game, a poker table game, a roulette table game, a craps table game, and a Texas hold'em table game.

19. A computer-implemented method comprising:

detecting, via one or more sensory devices of a wagering game table of a wagering game system, a start of a wagering table game being played by a plurality of players on the wagering game table;

presenting a cooperative secondary game on a plurality of display devices of the wagering game table for the plurality of players in response to detecting the start of the wagering table game;

detecting, via the one or more sensory devices, a plurality of game events associated with the wagering table game;

determining, at the wagering game table, that the plurality of players collectively have met a plurality of objectives associated with the cooperative secondary game based on the plurality of game events associated with the wagering table game;

presenting a bonus game on the plurality of display devices of the wagering game table in response to the players meeting the objectives associated with the cooperative secondary game;

determining, at the wagering game table, results associated with the bonus game; and presenting the results associated with the bonus game on the plurality of display devices of the wagering game table.

20. The method of claim 19, further comprising:

detecting, via one or more input devices of the wagering game table, player input associated with the bonus game;

receiving, at the wagering game table, random numbers from a wagering game server of the wagering game system via a communications network; and determining, at the wagering game table, the results associated with the bonus game based on the player input and the random numbers received from the wagering game server.

21. The method of claim 19, wherein said determining, at the wagering game table, results associated with the bonus game comprises receiving results from a wagering game server of the wagering game system via a communication network.

22. One or more non-transitory machine-readable storage media, having instructions stored therein, which when executed by one or more processors, causes the one or more processors to perform operations comprising:

detecting, via one or more sensory devices of a wagering game table, one or more game events associated with a wagering table game being played by a plurality of players on the wagering game table;

determining that the one or more game events trigger a secondary game for the plurality of players playing the wagering table game;

presenting the secondary game on a plurality of display devices of the wagering game table;

detecting, via one or more input devices of the wagering game table, player input associated with the secondary game;

determining results associated with the secondary game based, at least in part, on the player input; and presenting the results associated with the secondary game on the plurality of display devices of the wagering game table.

23. The non-transitory machine-readable storage media of claim 22, wherein the operations further comprise providing a monetary or non-monetary award to one or more of the players based on the results associated with the secondary game.

* * * * *